US008251113B2

(12) United States Patent
Baxter

(10) Patent No.: US 8,251,113 B2
(45) Date of Patent: Aug. 28, 2012

(54) HANDBAG, A SYSTEM A METHOD FOR INTERCHANGING STORAGE CONTAINERS

(76) Inventor: Aimee Richcreek Baxter, St. Paul, MN (US)

( * ) Notice: Subject to any disclaimer, the term of this patent is extended or adjusted under 35 U.S.C. 154(b) by 438 days.

(21) Appl. No.: 12/315,058

(22) Filed: Nov. 25, 2008

(65) Prior Publication Data

US 2009/0151826 A1 Jun. 18, 2009

Related U.S. Application Data

(60) Provisional application No. 61/004,733, filed on Nov. 29, 2007.

(51) Int. Cl.
*A45C 3/08* (2006.01)

(52) U.S. Cl. ..... 150/104; 150/103; 150/105; 150/112; 150/113; 150/900; 383/43; 383/119; 383/40; 383/37

(58) Field of Classification Search ..... 150/154, 150/900, 104, 112–117, 105; 383/34, 43, 383/119, 40, 37
See application file for complete search history.

(56) References Cited

U.S. PATENT DOCUMENTS 1,463,729 A * 7/1923 Stember ..... 150/101
1,556,352 A * 10/1925 Ritter ..... 383/34
1,960,396 A * 5/1934 Rosenberg ..... 150/105
2,118,400 A 5/1938 Goldberg
2,142,904 A * 1/1939 Lamarthe ..... 24/30.5 R
2,158,955 A * 5/1939 Blacber ..... 24/30.5 R
2,437,382 A * 3/1948 Czap ..... 150/105
2,653,640 A 9/1953 Browning
2,671,487 A 3/1954 Hoek
2,694,427 A 11/1954 Hovis
2,899,998 A 8/1959 Carroll
3,414,033 A 12/1968 Tucker
3,963,102 A * 6/1976 Carp ..... 190/108
4,718,524 A 1/1988 Crumley
4,811,769 A 3/1989 Phares
5,207,254 A * 5/1993 Fromm ..... 150/104
5,894,975 A 4/1999 Holden et al.
5,911,262 A 6/1999 Steinhart
6,003,573 A 12/1999 Owens
6,029,723 A 2/2000 Baquero et al.
6,070,628 A * 6/2000 Nastasi ..... 150/118
6,095,213 A 8/2000 Roegner
6,152,202 A * 11/2000 Magid ..... 150/112
6,179,025 B1 1/2001 Sutton
6,186,201 B1 2/2001 Salz
6,237,660 B1 5/2001 Giardino
6,394,157 B2 5/2002 Luna
6,446,688 B1 9/2002 Sutton
6,543,499 B2 4/2003 McCreery
6,561,240 B2 5/2003 Ma (Continued)

*Primary Examiner* — Tri Mai
(74) *Attorney, Agent, or Firm* — Patents & TMS, P.C.

(57) ABSTRACT

A handbag, a system and a method interchange storage containers which hold personal items and/or professional items. The handbag may have an outer shell that may have walls defining a cavity. The handbag has an insert with portions defining three or more containers. The handbag has a purse insert with sides defining an inner volume of the purse insert. The handbag has a purse shell with sections defining a chamber. The purse insert fits within the insert, and the insert fits within the outer shell. The purse insert may be transferred into an alternate insert, placed in a purse shell or carried independently. The insert is transferrable between the outer shell and an alternate outer shell. Moreover, the purse insert fits within the purse shell and is transferrable from the insert to the purse shell.

21 Claims, 11 Drawing Sheets

U.S. PATENT DOCUMENTS

| | | | | |
|---|---|---|---|---|
| 6,796,344 | B2 * | 9/2004 | Chen et al. | 150/113 |
| 6,820,664 | B1 | 11/2004 | Ritch | |
| 6,823,909 | B1 | 11/2004 | Marsteller | |
| 7,086,437 | B1 * | 8/2006 | Michael | 150/103 |
| 7,192,365 | B2 * | 3/2007 | Souza et al. | 473/329 |
| 7,461,676 | B2 * | 12/2008 | Huie | 150/105 |
| 7,789,114 | B2 * | 9/2010 | Pace et al. | 150/105 |
| 2002/0153074 | A1 * | 10/2002 | Chen et al. | 150/113 |
| 2005/0178485 | A1 | 8/2005 | Branson | |
| 2006/0021684 | A1 * | 2/2006 | DeCoro | 150/105 |
| 2006/0266452 | A1 * | 11/2006 | Huie | 150/105 |
| 2007/0163689 | A1 * | 7/2007 | Pace et al. | 150/105 |
| 2007/0209742 | A1 * | 9/2007 | Morgan | 150/105 |
| 2009/0188592 | A1 * | 7/2009 | Connacher et al. | 150/105 |

* cited by examiner

HANDBAG, A SYSTEM A METHOD FOR INTERCHANGING STORAGE CONTAINERS

This application claims the benefit of U.S. Provisional Application Ser. No. 61/004,733, filed Nov. 29, 2007.

BACKGROUND OF THE INVENTION

The present invention generally relates to a handbag, a system and a method for interchanging storage containers. More specifically, the present invention relates to a handbag, a system and a method for interchanging storage containers for storing personal items and/or professional items. The handbag may have an outer shell that may have walls which may be attached to and/or connected to each other to define a cavity. The handbag may have a purse shell which may have walls which may be attached to and/or connected to each other to define a cavity. The handbag may have an insert which may have two or more portions therein which may create more than one container. The handbag may have a purse insert which may have two or more sides attached to each other for defining a purse inner volume. The purse insert may fit within and/or may be received by the insert which may fit within and/or be received by the outer shell. Further, the purse insert may be placed into the insert which may be placed into the outer shell. Still further, the purse insert may fit within and/or may be received by the purse shell without the outer shell and the insert. Moreover, the purse insert may be removably inserted into the outer shell.

Traditionally, a handbag is used to store personal items and/or professional items, such as, for example, a wallet, makeup, sunglasses, a cell phone or a personal data assistant. The handbag is used as a fashion accessory that may conform to the different situations a user may encounter. A user transfers personal items and/or professional items based on a need for the handbag on a given day, week or other time period and/or for a particular event or occasion. When the personal items and/or professional items of the handbag are transferred to a small handbag, some contents are often left behind. Additionally, a user must utilize different storage configurations for different handbags. Thus, transferring contents from one handbag to another handbag is often difficult and time consuming.

Moreover, known handbags are typically not adaptable to the changing needs of the user. The user must often carry more personal items and/or professional items than may fit within the handbag, such as, for example, when the user carries a small diaper bag or a lunch tote. The user must utilize one or more additional handbags to carry the other personal items and/or professional items. Additionally, the user often desires to maintain current fashions and/or trends associated with handbags and their designs, styles and/or the like. The traditional handbag may not be modified for changing trends and/or fashions; as a result, a user must purchase a new handbag to conform with current trends and/or fashions. The organization of the known handbags varies with each handbag.

A need, therefore, exists for a handbag, a system and a method for interchanging storage containers which may have several removable storage containers within the handbag. Further, a need exists for a handbag, a system and a method for interchanging storage containers which may be configured for more than one storage requirement. Still further, a need exists for a handbag, a system and a method for interchanging storage containers which may allow a transfer of the storage containers between more than one outer shell for different aesthetic purposes and/or utilitarian purposes.

Moreover, a need exists for a handbag, a system and a method for interchanging storage containers which may allow contents of the handbag to be transferred without omitting items from the previous handbag. Moreover, a need exists for a handbag, a system and a method for interchanging storage containers which may utilize a constant storage configuration for ease of use.

SUMMARY OF THE INVENTION

The present invention relates to a handbag, a system and a method for interchanging storage containers. More specifically, the present invention relates to a handbag, a system and a method for interchanging storage containers for storing personal items and/or professional items. The handbag may have an outer shell with walls defining a cavity. The handbag may have an insert which may have portions defining containers. The handbag may have a purse insert which may have sides defining a purse inner volume of the purse insert. The handbag may have a purse shell which may have sections defining a chamber. The outer shell may be adapted to receive the insert. The insert may be adapted to receive the purse insert. The purse shell may be adapted to receive the purse insert.

The outer shell may have one or more flaps that may be used to retain and/or enclose the insert within the outer shell. Alternatively, the outer shell may have fasteners and/or magnets and/or the like to retain and/or enclose the insert within the outer shell. The insert may conform to the interior of the outer shell. The insert may be shaped to fold under the one or more flaps located on the outer shell. Alternatively, the insert may have fasteners and/or metal sections that fasten and/or magnetically connect to the fasteners and/or magnets of the outer shell. The insert may have an opening which may be defined by an internal flex frame. The internal flex frame may be positioned under one or more flaps of the outer shell. The insert may have a second opening to removably receive the purse insert. Further, the second opening may have fasteners located near the ends of the opening.

The second opening of the insert may have one or more flaps and/or one or more fasteners for securing the purse insert into the second opening of the insert. One or more flaps on the insert may extend into the purse insert. Alternatively, the sides of the second opening of the insert may have magnets and the sides of the purse insert may be made of metal for securing the purse insert into the second opening of the insert. The purse insert may conform to the interior of the insert. Additionally, the purse insert may have a flexible frame which may be located around a main opening of the purse insert. The flexible frame may be metal. The flexible frame may further have members that may be connected to one or more hinges. Each of the hinges may have a torsional spring which may resist separation of the members and thereby close the purse insert.

The handbag may be designed to allow the insert and/or the purse insert to be removed from the outer shell and/or the purse insert to be removed from the purse shell. The insert may have handles or other ergonomic devices which may facilitate the removal of the insert from the outer shell. A user may separate the outer shell from the insert by folding the one or more flaps located on the outer shell inwardly or outwardly with respect to the insert. A user may alternatively separate the outer shell from the insert and/or the purse shell from the purse insert by applying a force to overcome a magnetic force between the magnets of the outer shell and the metal sections of the insert and/or the magnets of the purse shell and the metal sections of the purse insert. Further, a user may separate the purse insert from the insert by applying a force to overcome a magnetic force between the magnets of the insert and the metal sections of the purse insert. Further, a user may also remove the one or more panels located on the insert away from the purse insert. Moreover, a user may apply a force to overcome a contact between the outer shell and the insert and/or between the insert and the purse insert.

It is, therefore, an advantage of the present invention to provide a handbag, a system and a method for interchanging storage containers which may have at least three containers of different sizes which may be removably inserted with each other.

And, another advantage of the present invention is to provide a handbag, a system and a method for interchanging storage containers which may allow an insert and a purse insert to be inserted into and removed from one outer shell to another.

Yet another advantage of the present invention is to provide a handbag, a system and a method for interchanging storage containers which may allow a constant storage configuration within an insert and a purse insert for transferring storage containers between outer shells.

Another advantage of the present invention is to provide a handbag, a system and a method for interchanging storage containers which may allow a constant storage volume within an insert and a purse insert for transferring storage containers between outer shells.

A further advantage of the present invention is to provide a handbag, a system and a method for interchanging storage containers wherein a shape of an outer shell, of an insert and of a purse are based on an orientation of the outer shell, of the insert and of the purse.

An additional advantage of the present invention is to provide a handbag, a system and a method for interchanging storage containers wherein the system may be interchangeable with a variety of different bags and/or luggage.

A still further advantage of the present invention is to provide a handbag, a system and a method for interchanging storage containers which may use one or more springs and/or hinge mechanisms to define a shape of an insert and a purse insert.

Moreover, an advantage of the present invention is to provide a handbag, a system and a method for interchanging storage containers which may appear to be a traditional handbag by nesting one or more storage containers that store non-traditional items such as a laptop within an outer shell.

And, another advantage of the present invention is to provide a handbag, a system and a method for interchanging storage containers which may provide one or more flaps or one or more sets of magnets or other fasteners for securing containers within the handbag.

Yet another advantage of the present invention is to provide a handbag, a system and a method for interchanging storage containers which may utilize one or more fabric or color patterns on the storage pockets of the inserts to indicate one or more storage areas and to help a user easily distinguish placement or function of the pockets.

A still further advantage of the present invention is to provide a handbag, a system and a method for interchanging storage containers which may allow the storage containers to be inserted into and/or removed from the outer shell based on storage requirements.

Another advantage of the present invention is to provide a handbag, a system and a method for interchanging storage containers which may have a purse shell for carrying a purse insert without the outer shell and the insert.

Yet another advantage of the present invention is to provide a handbag, a system and a method for interchanging storage containers which may allow for added flexibility for a traveler to change the function of his or her handbag by only packing alternate outer shells and purse shells.

Additional features and advantages of the present invention are described in, and will, be apparent from, the detailed description of the presently preferred embodiments and from the drawings.

BRIEF DESCRIPTION OF THE PRESENTLY PREFERRED EMBODIMENTS

DETAILED DESCRIPTION OF THE PRESENTLY PREFERRED EMBODIMENTS

The present invention generally relates to a handbag, a system and a method for interchanging storage containers. More specifically, the present invention relates to a handbag, a system and a method for interchanging storage containers for storing personal items and/or professional items, such as, for example, a personal digital assistant, a laptop, a digital music player, a wallet, keys, cellular telephone and/or the like. The handbag may have an outer shell that may have portions for defining a compartment. The handbag may have an insert which may have portions arranged for defining compartments. The handbag may have a purse insert which may have portions for defining a compartment. The handbag may have a purse shell which may have sections for defining a chamber. The compartment of the outer shell may be sized to receive and/or to store the insert. The one or more compartments of the insert may be sized to receive and/or to store the purse insert.

Figure 1A:
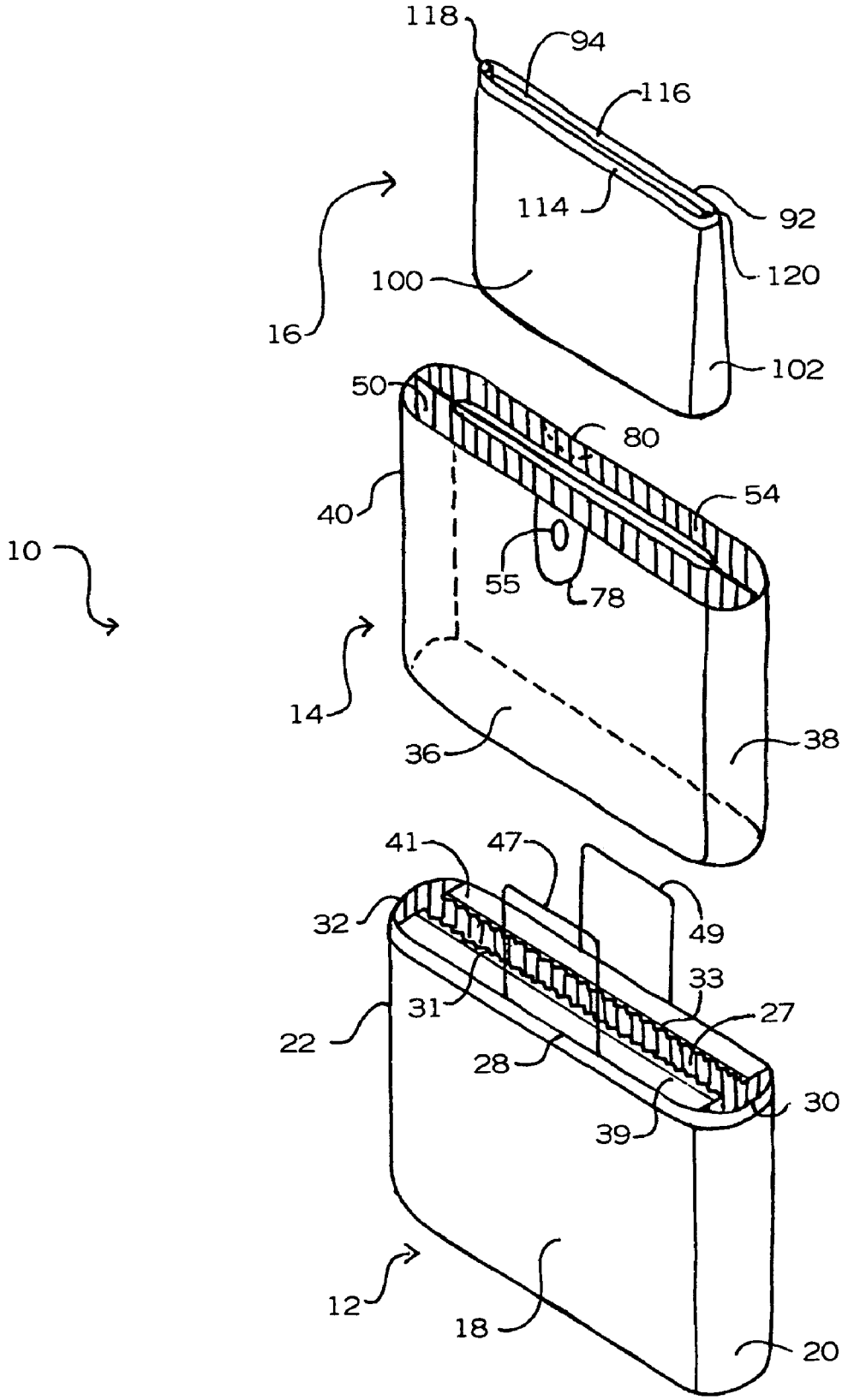
FIG. 1A illustrates an exploded perspective view of a handbag with removable storage containers in an embodiment of the present invention.
Figure 2A:
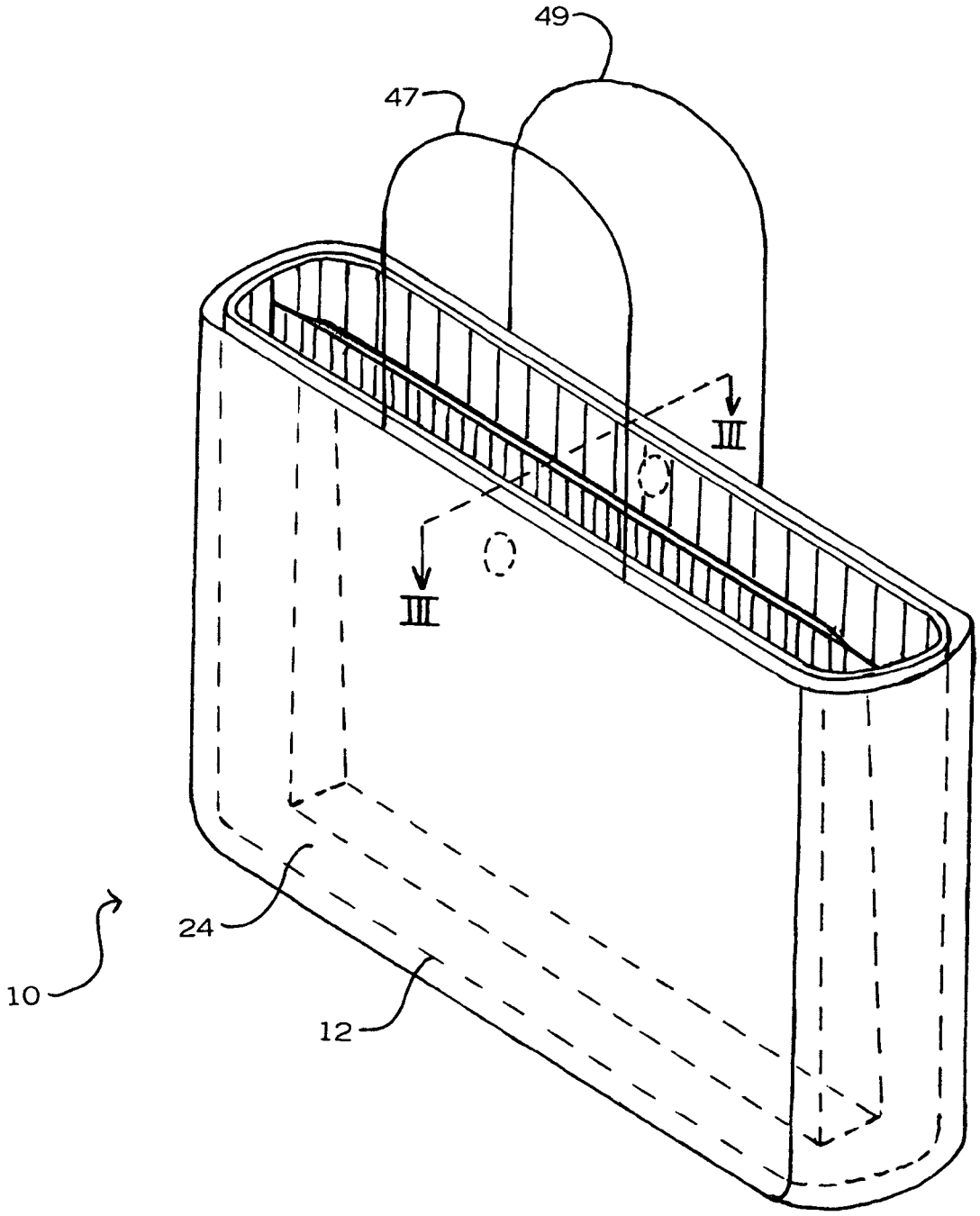
FIG. 2A illustrates a perspective view of a handbag with an outer shell, an insert and a purse insert in an embodiment of the present invention.
Figure 3:
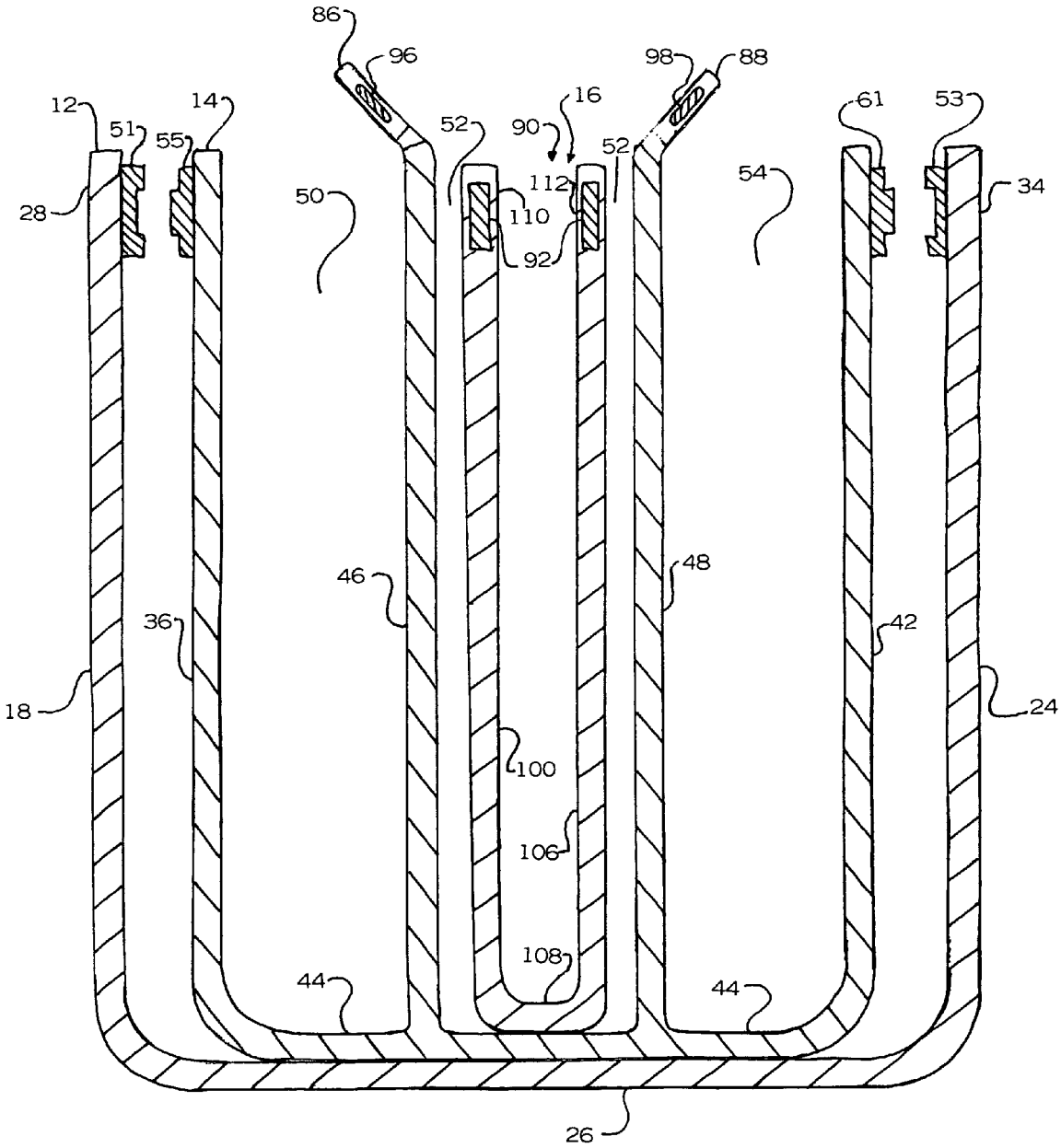
FIG. 3 illustrates a cross-sectional view of a handbag generally taken along the line III-III in FIG. 2A in an embodiment of the present invention.

Referring now to the drawings wherein like numerals refer to like parts, FIG. 1A illustrates a handbag 10 in an embodiment of the present invention. The handbag 10 may have an outer shell 12, an insert 14 and/or a purse insert 16. The outer shell 12 may be made from one or more materials, such as, for example, leather, plastic, fiber, and/or the like. The outer shell 12 may have a front wall 18, a right wall 20 and/or a left wall 22 as shown in FIG. 2A. Further, the outer shell 12 may have a back wall 24 and/or a bottom wall 26 as shown in FIG. 3. The front wall 18, the right wall 20, the left wall 22, the back wall 24 and/or the bottom wall 26 of the outer shell 12 may define a cavity 27 which may be adapted to and/or sized to receive the insert 14. Moreover, the front wall 18, the right wall 20, the left wall 22, the back wall 24 and/or the bottom wall 26 of the outer shell 12 may be shaped to store and/or enclose the insert 14 via contact between the outer shell 12 and the insert 14, fasteners between the outer shell 12 and the insert 14, magnets between the outer shell 12 and the insert 14 or other like means. The present invention should not be deemed as limited to a specific embodiment of the material of the outer shell 12.

Figure 1B:
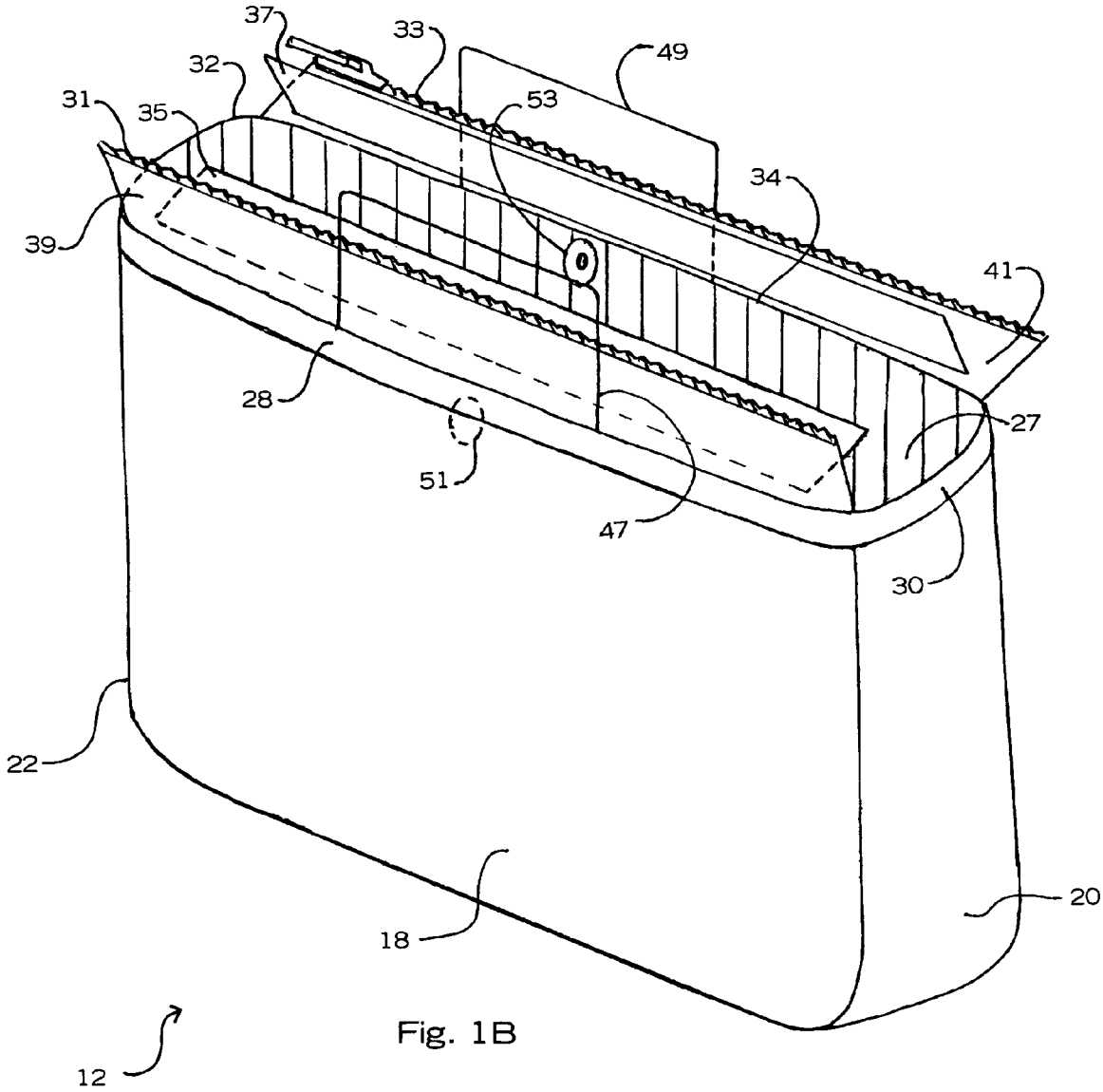
FIG. 1B illustrates a perspective view of an outer shell in an embodiment of the present invention.

As shown in FIG. 1B and FIG. 3, the outer shell 12 may have a front edge 28, a right edge 30, a left edge 32 and/or a back edge 34. The front edge 28, the right edge 30, the left edge 32 and/or the back edge 34 may be made from the same material as the outer shell 12. In an embodiment, the front edge 28, the right edge 30, the left edge 32 and/or the back edge 34 may be made from a material, such as, for example, reinforced fabric, plastic, leather and/or the like. Further, the front edge 28 may be attached to the front wall 18, the right edge 30 may be attached to the right wall 20, the left edge 32 may be attached to the left wall 22 and/or the back edge 34 may be attached to the back wall 24. The front edge 28, the right edge 30, the left edge 32 and/or the back edge 34 may be attached to their respective walls of the outer shell 12 by, for example, stitching, adhesive, and/or the like.

Still further, as illustrated in FIG. 1B, a front extension 39 may be attached to the inside of the front wall 18 substantially near the front edge 28, and a back extension 41 may be attached to the inside of the back wall 24 substantially near the back edge 34. The front extension 39 and the back extension 41 may extend along their respective walls from the right edge 30 to the left edge 32. A front fastener 31 may be attached to the unattached edge of the front extension 39, and a back fastener 33 may be attached to the unattached edge of the back extension 41. The front fastener 31 and the back fastener 33 may be a zipper or the like. Further, the front fastener 31 may attach to the back fastener 33 to enclose the cavity 27 of the outer shell 12 and/or to secure the insert 14 into the outer shell 12. Still further, a front flap 35 may be attached to the underside of the front extension 39, and a back flap 37 may be attached to the underside of the back extension 41. The front flap 35 and the back flap 37 may secure the insert 14 into the outer shell 12 and any contents of the outer shell 12 and/or the insert 14 into their respective containers.

The outer shell 12 may have a front shell connector 51 and a back shell connector 53, as shown in FIG. 1B and FIG. 3. The front shell connector 51 and the back shell connector 53 may be a hook or a latch or the like. In an embodiment, the front shell connector 51 and the back shell connector 53 may be magnetized and may have a washer base and a hole substantially in the center of the washer base (not shown in the figures). In another embodiment, the front shell connector 51 and the back shell connector 53 may be a combination of a swimsuit type S-hook and a loop. One end of the S-hook may be stitched or otherwise secured to the inside wall of the outer shell 12, and the other end of the S-hook may be a free end so that the user may manipulate the free end into the loop stitched or otherwise secured to the outside wall of the insert 14. Alternatively, the S-hook may be secured to the insert 14, and the loop may be secured to the outer shell 12. The user simply inserts the free end of the S-hook into the loop to support the insert 14 inside the outer shell 12 and prevent sagging when items are placed within the insert 14 and/or the outer shell 12. In a preferred embodiment, four S-hooks and loops are used to support the insert 14 within the outer shell 12, i.e. two S-hooks and loops on each side of the insert 14. Of course, any number of S-hooks and loops may be used depending on the application and/or size and/or types of materials used or the like for the insert 14 and/or the outer shell 12. Further, the front shell connector 51 may be attached to the top center of the front wall 18, and the back shell connector 53 may be attached to the top center of the back wall 24, as shown in FIG. 1B and FIG. 3. The front shell connector 51 may be attached to the top center of the front wall 18 and the back shell connector 53 may be attached to the top center of the back wall 24 by, for example, adhesive and/or the like.

In an embodiment, the outer shell 12 may be shaped in a style of handbag, such as, for example, a messenger bag, a purse, a briefcase, a suitcase and/or the like. As shown in FIG. 1A and FIG. 1B, the outer shell 12 may have a front strap 47 and/or a back strap 49 to aid a user in carrying the handbag 10. The front strap 47 and the back strap 49 may be made from a material, such as, for example, plastic, leather, rope and/or the like. The front strap 47 and the back strap 49 may be removably attached to and/or connected to the outer shell 12. Moreover, the outer shell 12 may have one or more ergonomic devices in place of and/or in addition to the front strap 47 and the back strap 49, such as, for example, a shoulder strap, a wrist strap, a backpack and/or the like (not shown in figures). The present invention should not be deemed as limited to a specific embodiment of the material of the outer shell 12.

In an embodiment, the outer shell 12 may have other features, such as, for example, pockets, closures, straps and/or the like. The features may be oriented in different ways throughout the outer shell. Further, the outer shell 12 may have exterior features to increase the aesthetic appeal of the handbag 10, such as, for example, textures, indicia, designs and/or the like. The outer shell 12 may have one or more fasteners, such as, for example, snap fasteners, zippers, hook and loop fasteners, magnets and/or the like. One or more fasteners may secure the items stored within the outer shell 12 and may make the combination a whole handbag unit. The present invention should not be deemed as limited to a specific embodiment of the material of the outer shell 12.

Figure 1C:
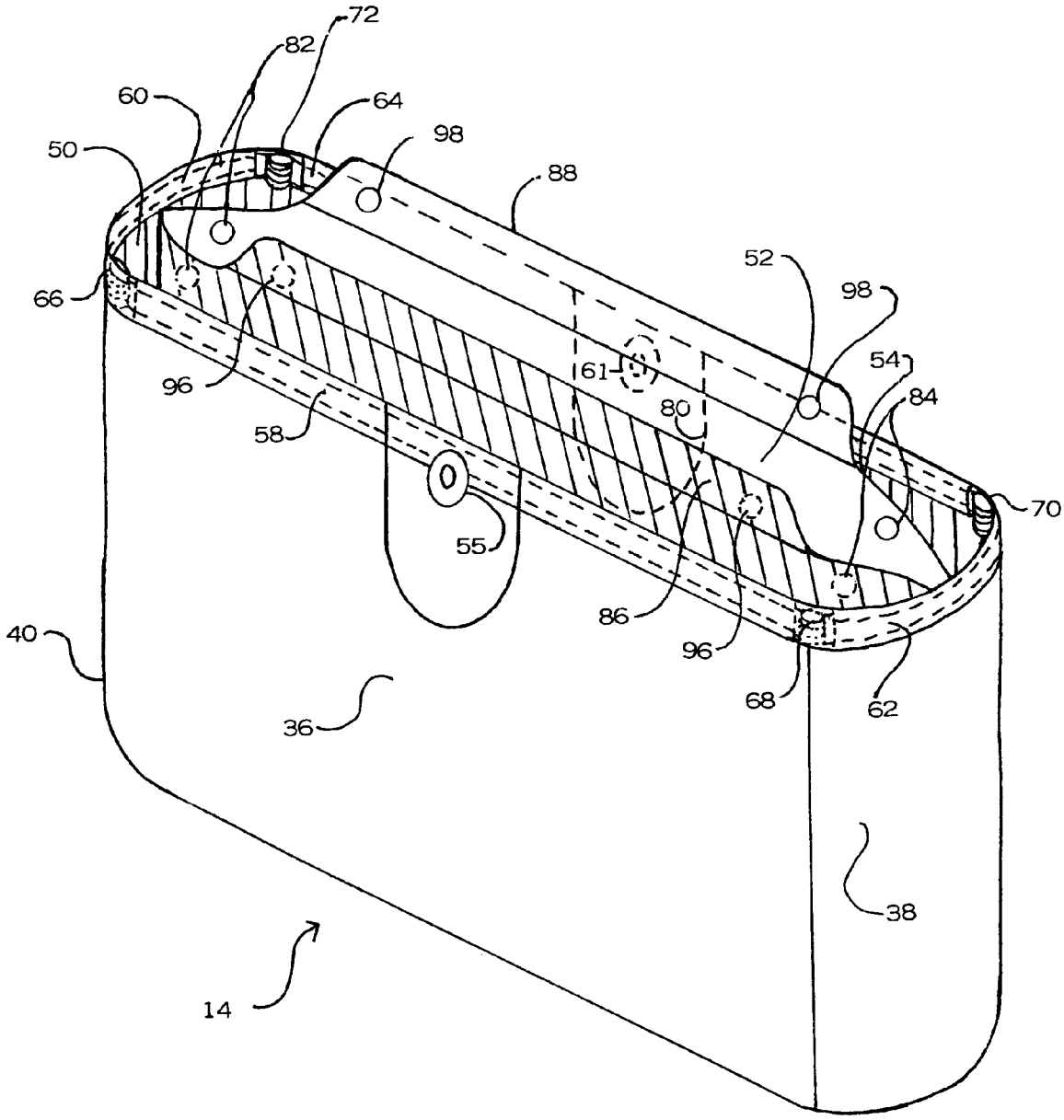
FIG. 1C illustrates a perspective view of an insert in an embodiment of the present invention.

As illustrated in FIGS. 1A, 1C and 3, the insert 14 may have a front portion 36, a right portion 38, a left portion 40, a back portion 42, a bottom portion 44, an inner front portion 46 and/or an inner back potion 48. The front portion 36, the right portion 38, the left portion 40, the back portion 42, the bottom portion 44, the inner front portion 46 and/or the inner back portion 48 may be connected to define a front container 50, a center container 52 and/or a rear container 54, as shown in FIG. 3. The insert 14 may have one or more storage pockets (not shown in figures) located on the inside of the front portion 36, the right portion 38 and/or the left portion 40. The insert 14 may be made from one or more materials, such as, for example, plastic, leather, cardboard, and/or the like. Further, the insert 14 may be made from a material having stiffening members to define the shape of the insert 14. Still further, the insert 14 may have designs, indicia, combinations of fabrics and/or the like to improve and/or to increase the aesthetic appearance of the insert 14.

Moreover, as shown in FIG. 1A, the insert 14 may utilize an internal flex frame 56 that may define spatial relationships between and may be integrally formed with the front portion 36, the right portion 38, the left portion 40 and/or the back portion 42. The internal flex frame 56 may be attached via stitching the material of the insert 14 around the flex frame 56. Further, the internal flex frame 56 may be attached to the insert 14 substantially near the tops of the front portion 36, the right portion 38, the left portion 40 and/or the back portion 42. The flex frame 56 may deform elastically and may be a continuous piece of plastic and/or metal or the like. In an embodiment, as shown in FIG. 1C, the flex frame 56 may have a front member 58, a left member 60, a right member 62 and/or a back member 64. The front member 58, the left member 60, the right member 62 and the back member 64 may be connected to each other by a set of hinges 66, 68, 70 and 72.

In an embodiment, the insert 14 may have one or more ergonomic devices for removing the insert 14 from the outer shell 20. For example, as shown in FIG. 1C, the front portion 36 may have a front cutout 78 and/or the back portion 42 may have a back cutout 80. The front cutout 78 and the back cutout 80 may be sized and/or may be shaped to receive one or more fingers of a user. The user may place one or more fingers through the front cutout 78 and/or the back cutout 80 to grasp the insert 14. The user may then remove and/or may separate the insert 14 from the outer shell 12.

In an embodiment, the insert 14 may have a front connector 55 and a back connector 61, as shown in FIG. 1B and FIG. 3. The front connector 55 may be attached to the top center of the front portion 36, and the back connector 61 may be attached to the top center of the back portion 42, as shown in FIG. 3. The front connector 55 may be attached to the top center of the front portion 36, and the back connector 61 may be attached to the top center of the back portion 42 by, for example, adhesive and/or the like. The front connector 55 may attach to the front shell connector 51 of the outer shell, and the back connector 61 may attach to the back shell connector 53 of the outer shell 12. This attachment may removably secure the insert 14 into the outer shell 12. The attachments may be a hook and loop fastener, magnets, snap fastener and/or the like. A user may separate the insert 14 from the outer shell 12 by applying a force to overcome the attachment between the front connector 55 and the front shell connector 51, and the back connector 61 and the back shell connector 53.

Figure 1D:
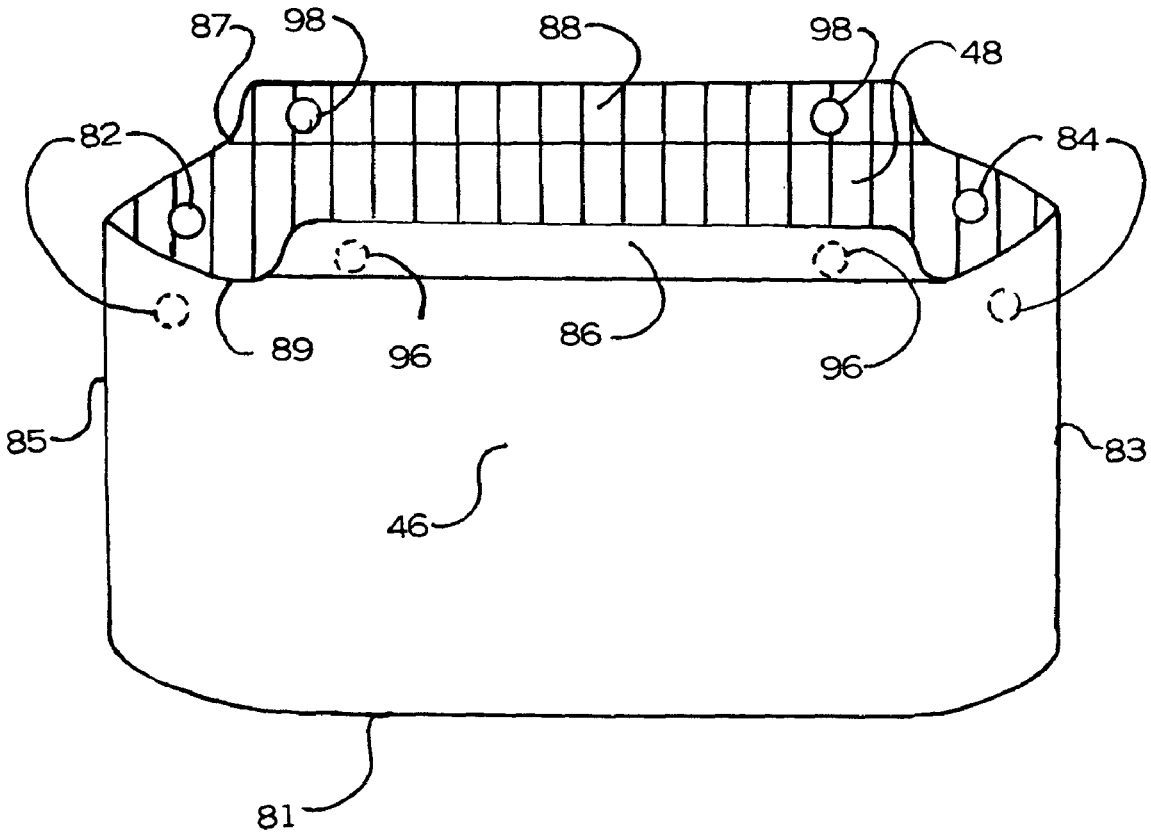
FIG. 1D illustrates a perspective view of a portion of an insert in an embodiment of the present invention.

As illustrated in FIG. 3, the center container 52 of the insert 14 may be adapted and/or may be sized to receive the purse insert 16. The inner front portion 46 and the inner back portion 48 may define a shape that conforms to the purse insert 16. Further, the shape of the inner front portion 46 and the inner back portion 48 may position the purse insert 16 within the insert 14 in a manner that provides access to the purse insert 16. FIG. 1C and FIG. 1D illustrate that the insert 14 may have a left fastener 82 and/or a right fastener 84. The left fastener 82 and/or the right fastener 84 may be, for example, a snap fastener, a zipper, a hook and loop fastener and/or the like. The left fastener 82 and/or the right fastener 84 may be closed which may exert a force on the inner front portion 46 and/or the inner back portion 48. The inner front portion 46 and the inner back portion 48 may be forced against the purse insert 16 to restrict the movement of the purse insert 16 within the insert 14 or to allow the purse insert 16 to be removed more easily.

As shown in FIG. 1D and FIG. 3, the insert 14 may have a front panel 86 which may be attached to the top of the inner front portion 46, and a back panel 88 which may be attached to the top of the inner back portion 48. The front panel 86 may rotate with respect to the inner front portion 46, and the back panel 88 may rotate with respect to the inner back portion 48. Further, the front panel 86 may have a front magnet 96, and the back panel 88 may have a back magnet 98. The front panel 86 and/or the back panel 88 may be made from one or more materials, such as, for example, fabric, leather, plastic and/or the like. The present invention should not be deemed as limited to a specific embodiment of the material of the insert 14.

As shown in FIG. 1D, the inner front portion 46 and the inner back portion 48 may be constructed with an inner base side 81, a right inner side 83, a left inner side 85, a top inner back side 87 and/or a top inner front side 89. The top inner front side 89 of the inner front portion 46 and the top inner back side 87 of the inner back portion 48 may be longer than the inner base side 81. Further, the left inner side 85 and the right inner side 83 may connect the inner base side 81 to the top inner front side 89 and the top inner back side 87. Still further, the left inner side 85 and the right inner side 83 may be angled with respect to the inner base side 81 which may accommodate the difference in length between the inner base side 81 and the top inner front side 89 and the top inner back side 87. The front panel 86 may be attached to the top inner front side 89 and the back panel 88 may be attached to the top inner back side 87.

Figure 1E:
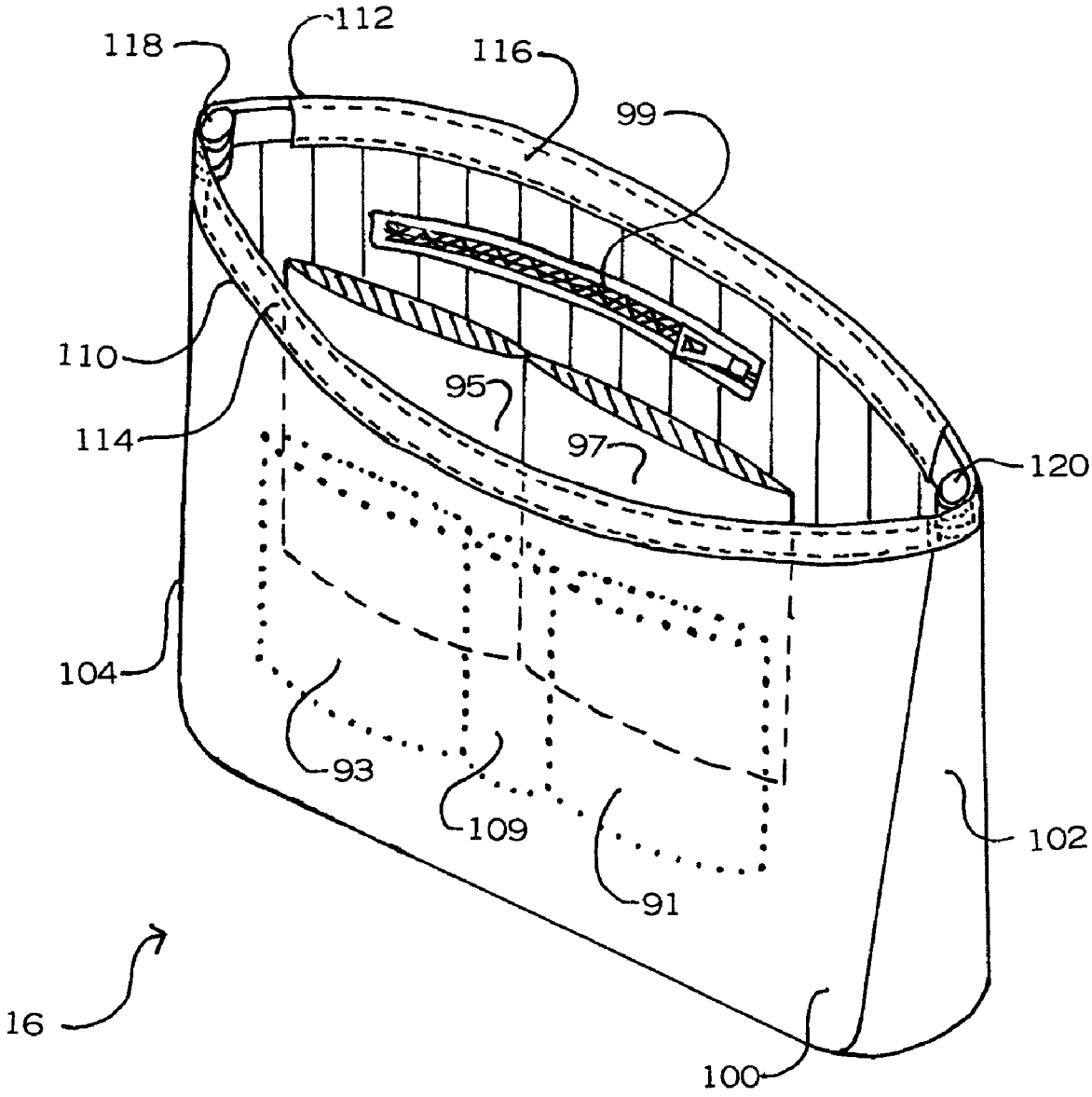
FIG. 1E illustrates a perspective view of a purse insert in an embodiment of the present invention.

As shown in FIG. 3, the front panel 86 and/or the back panel 88 of the insert 14 may be sized to extend into a purse inner volume 90 of the purse insert 16. As shown in FIG. 1A and FIG. 1E, the purse insert 16 may have a flexible frame 92 located adjacent to the main opening 94 of the purse insert 16. The flexible frame 92 may be metal. Further, the front magnet 96 of the front panel 86 of the insert 14 and/or the back magnet 98 of the back panel 88 of the insert 14 may be attracted to and/or connected to the flexible frame 92 of the purse insert 16. Moreover, this magnetic attraction may connect the purse insert 16 to the front panel 86 and/or to the back panel 88 to removably secure the purse insert 16 into the insert 14.

The insert 14 may have a front container 50, a center container 52 and/or a rear container 54, as shown in FIG. 1C and FIG. 3. The front container 50, the center container 52 and/or the rear container 54 of the insert 14 may be made from different fabrics and/or different patterns and/or different colors to allow a user to visually identify the contents of each of the containers 50, 52 and 54. Further, the insert 14 may be used in other applications, such as a briefcase or a suitcase (see FIGS. 6A, 6B and 6C), that may be adapted to receive the insert 14. Still further, the insert 14 may have one or more fasteners, such as, for example, snap fasteners, zippers and/or the like. Moreover, the insert 14 may have features that increase the aesthetic appeal of the bag, such as, for example, textures, indicia, designs and/or the like.

The purse insert 16 may be made from one or more materials, such as, for example, leather, cloth, plastic, and/or the like. As shown in FIGS. 1A, 1E and 3, the purse insert 16 may have a front side 100, a right side 102, a left side 104, a back side 106 and/or a bottom side 108. The front side 100, the right side 102, the left side 104, the back side 106 and/or the bottom side 108 may be connected to define a purse insert cavity 90. As shown in FIG. 1E, the purse insert cavity 90 may have a zippered pocket 99 and/or one or more storage pockets 91, 93, 95, 97 and 109. The zippered pocket 99 may have a closing mechanism, such as, for example, a zipper. The storage pockets 91, 93, 95, 97 and 109 may each be a different color of fabric to allow a user to visually identify the contents of each pocket or to ascertain which pocket to utilize. Further, each of the storage pockets 91, 93, 95, 97 and 109 may have a closing mechanism, such as, for example, a zipper, a snap fastener, a magnet and/or the like (not shown in figures). Still further, the zippered pocket 99 and one or more of the storage pockets 91, 93, 95, 97 and 109 may be adapted to receive a particular type of personal item and/or professional item, such as, for example, a personal digital assistant, a digital music player, keys and/or the like. Alternatively, or in addition to the storage pockets that may be on the inside of the insert 16, storage pockets (not shown) may be provided on the exterior walls of the insert 16. The storage pockets are preferably sized for convenient storage and/or access to keys, a cellular telephone, and/or the like. The storage pockets may have a gusseted wall and/or an elasticized opening for storage and/or access as well as to provide a variable amount of space within the storage pocket. In a preferred embodiment, at least two pockets are provided on one side of the exterior walls of the insert 16, but it should be understood that any number of pockets of any size and/or shape may be provided on the inside of the insert 16 and/or on the exterior walls of the insert 16.

The purse insert 16 may have a main opening 94 as shown in FIG. 1A. As shown in FIG. 1E, the main opening 94 may be defined by a front rim 110 and/or a back rim 112. The main opening 94 may be opened when the front rim 110 is separated from the back rim 112. Conversely, the front rim 110 and/or the back rim 112 may collapse together and may close and/or may seal the main opening 94. The left fastener 82 and/or the right fastener 84 may be closed which may compress together the inner front portion 46 and/or the inner back portion 48 of the insert 14. The inner front portion 46 may apply a force to the front rim 110 and/or the inner back portion 48 may apply a force to the back rim 112. Further, the front panel 86 and/or the back panel 88 of the insert 14 may extend over the front rim 110 and/or the back rim 110 and into the purse inner volume 90. Still further, the front rim 110 and/or the back rim 112 of the purse insert 16 may collapse around the front panel 86 and the back panel 88 of the insert 14 which may close or seal the main opening 94 of the purse insert 16.

As shown in FIG. 1A and FIG. 3, the flexible frame 92 of the purse insert 16 may be within the front rim 110 and the back rim 112. The flexible frame 92 may have a front flexible element 114 and/or a back flexible element 116. The front flexible element 114 and/or the back flexible element 116 may be stitched into the same material as the material of the front side 100 and/or the back side 106 of the purse insert 16. Further, the front flexible element 114 and/or the back flexible element 116 may be made from metal and/or another material which may deform elastically. The front flexible element 114 may be connected to the back flexible element 116 at a left joint 118. The left joint 118 may have a torsional spring (not shown in the figures) to exert a moment about the left joint 118. The moment exerted by the torsional spring around the left joint 118 may force the front flexible element 114 toward the back flexible element 116.

Further, the front flexible element 114 may be connected to the back flexible element 116 at a right joint 120. The right joint 120 may have a torsional spring (not shown in the figures) which may exert a moment about the right joint 120. The moment exerted by the torsional spring around the right joint 120 may force the back flexible element 116 toward the front flexible element 114. Further, the moments acting about the left joint 118 and the right joint 120 may tend to keep the front flexible element 114 in contact with the back flexible element 116.

The user may enlarge the main opening 94 by applying a force to overcome the moments of the left joint 118 and the right joint 120. As a result, the front flexible element 114 may be separated from the back flexible element 116 to unseal the purse inner volume 90.

Figure 4:
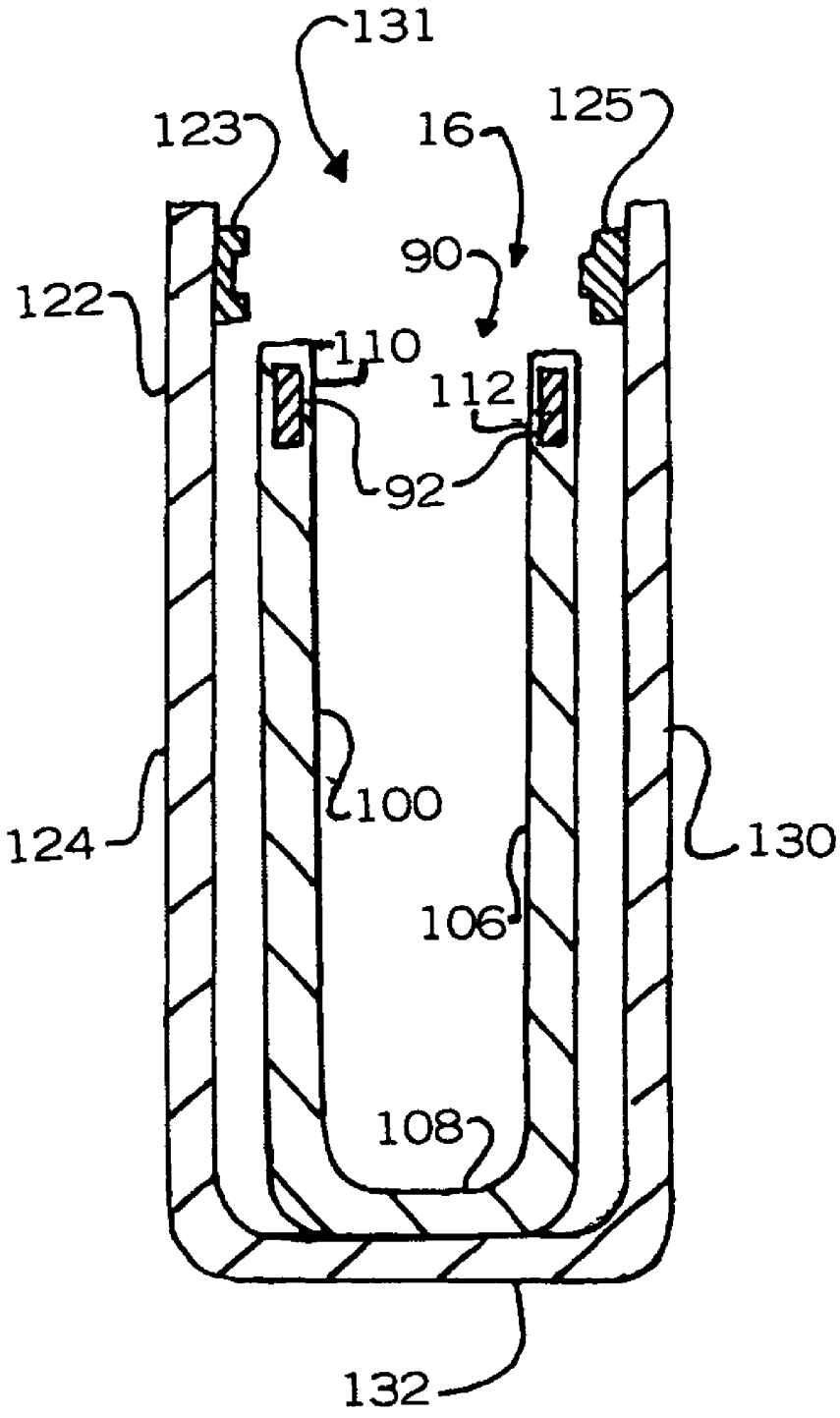
FIG. 4 illustrates a cross-sectional view of a handbag generally taken along the line IV-IV in FIG. 2B in an embodiment of the present invention.
Figures 5A, 5B:
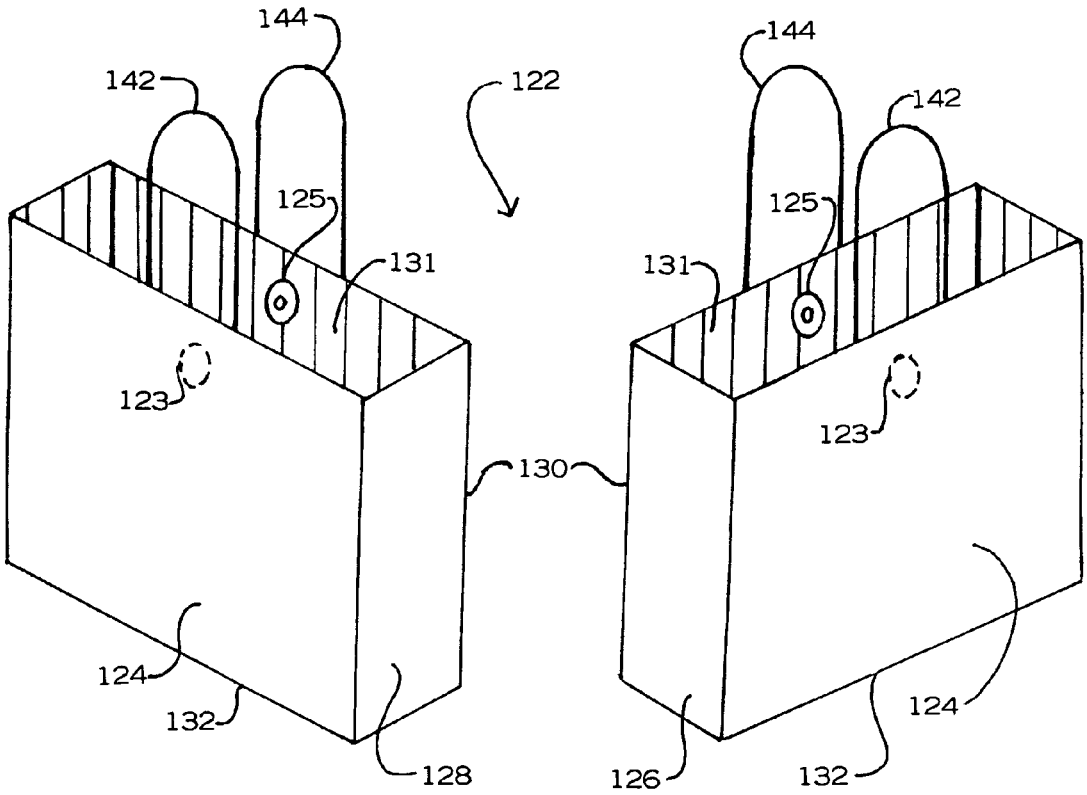
FIG. 5A illustrates a perspective view of a purse shell in an embodiment of the present invention.
FIG. 5B illustrates a perspective view of a purse shell in an embodiment of the present invention.

As shown in FIGS. 4, 5A and 5B, the handbag 10 may have a purse shell 122. The purse shell 122 may be adapted and/or may be sized to receive the purse insert 16. Further, the purse shell 122 may have a front section 124, a left section 126, a right section 128, a back section 130 and/or a bottom section 132 defining a chamber 131. The purse shell 122 may be made from one or more materials, such as, for example, plastic, leather, fabric, and/or the like. The present invention should not be deemed as limited to a specific embodiment of the material of the purse shell 122.

In an embodiment, as shown in FIG. 5A and FIG. 5B, the purse shell 122 may have a front fastener 123 and/or a back fastener 125. The front fastener 123 may be attached to the top of the inside of the front section 124, and the back fastener 125 may be attached to the top of the inside of the back section 130. Further, the front fastener 123 and the back fastener 125 may be attached to the respective sections of the purse shell 122 by, for example, stitching, adhesive, and/or the like. The user may removably secure the front section 124 to the back section 130 via an attachment between the front fastener 123 and the back fastener 125. The attachment may be a hook and loop fastener, magnets, snap fastener and/or the like.

The purse shell 122 may be used to store the purse insert 16 when a situation may not require the outer shell 12 and/or the insert 14. For example, social events after work or lunch hour during work hours may not require professional items. Instead, the user may take only personal items which may be stored within the purse insert 16, such as, for example, a wallet, keys and/or the like. In an embodiment, the purse shell 122 may be shaped in a style of handbag, such as, for example a messenger bag, a purse and/or the like.

The purse shell 122 may have designs, indicia, fabrics and/or the like to improve the aesthetic appearance of the purse shell 122. The purse shell 122 may have a front handle 142 attached to the front section 124 and/or a back handle 144 attached to the back section 130, as shown in FIG. 5A and FIG. 5B. The front handle 142 and/or the back handle 144 may be made from a material, such as, for example, leather, plastic, rope and/or the like. The front handle 142 and/or the back handle 144 may be removably attached to and/or connected to the purse shell 122. The purse shell 122 may have other ergonomic devices in place of and/or in addition to the front handle 142 and/or the back handle 144, such as, for example, a shoulder strap, a wrist strap, a backpack and/or the like. The present invention should not be deemed as limited to a specific embodiment of the material of the purse shell 122.

As illustrated in FIG. 1A, the insert 14 and the purse insert 16 may be interchanged by the user to be housed and/or to be stored within the outer shell 12. The outer shell 12 may have aesthetic value and/or utilitarian value which may be desired by the user in different social settings and/or professional settings. The user may connect the insert 14 to the new outer shell 12 by placing the insert 14 into the cavity 27 of the outer shell 12 as shown in FIG. 1A. The user may place the front portion 36, the right portion 38, the left portion 40 and/or the back portion 42 of the insert 14 under the respective front edge 28, right edge 30, left edge 32 and/or back edge 34 of the outer shell 12. The user may further secure the insert 14 into the outer shell 12 by placing the top of the front portion 36 of the insert 14 under the front flap 35 of the outer shell 12 and the top of the back portion 42 of the insert 14 under the back flap 37 of the outer shell 12. Still further, the user may secure the insert 14 into the outer shell 12 by attaching the front fastener 31 of the outer shell 12 to the back fastener 33 of the outer shell 12.

In an embodiment, the user may removably secure the inside of the front wall 18 of the outer shell 12 to the front portion 36 of the insert 14 via an attachment between the front shell connector 51 of the outer shell 12 and the front connector 55 of the insert 14. Further, the user may removably secure the inside of the back wall 24 of the outer shell 12 to the back portion 42 of the insert 14 via an attachment between the back shell connector 53 of the outer shell 12 and the back connector 61 of the insert 14. The attachments may be a hook and loop fastener, magnets, snap fastener and/or the like.

The insert 14 may be separated from the outer shell 12 by rotating the front edge 28, the right edge 30, the left edge 32 and/or the back edge 34 of the outer shell 12 outwardly and pushing down on the outer shell 12 with respect to the insert 14. Further, the insert 14 may be separated from the outer shell 12 by removing the front portion 36 of the insert 14 from under the front flap 35 of the outer shell 12 and the back portion 42 of the insert 14 from under the back flap 37 of the outer shell 12. Alternatively, the user may separate the insert 14 from the outer shell 12 by applying a force to overcome the attachments between the front shell connector 51 of the outer shell 12 and the front connector 55 of the insert 14, and the back shell connector 53 of the outer shell 12 and the back connector 61 of the insert 14.

As shown in FIG. 3, the purse insert 16 may be inserted into the center container 52 of the insert 14. As shown in FIG. 1D, the left fastener 82 and/or the right fastener 84 may be closed which may engage the purse insert 16 between the inner front portion 46 and/or the inner back portion 48. The front panel 86 and/or the back panel 88 of the insert 14 may be placed through the main opening 94 of the purse insert 16 and into the purse inner volume 90 of the purse insert 16.

As shown in FIG. 3, the front panel 86 and/or the back panel 88 of the insert 14 may extend into the purse inner volume 90 of the purse insert 16. As illustrated in FIGS. 1A, 1C and 3, the front panel 86 of the insert 14 may have a front magnet 96. The front magnet 96 may be magnetically attracted to the material of the front flexible element 114 of the purse insert 16. Further, a magnetic force between the front magnet 96 and the front flexible element 114 may connect the purse insert 16 to the insert 14.

Further, as illustrated in FIGS. 1A, 1C and 3, the back panel 88 of the insert 14 may have a back magnet 98. The back magnet 98 may be magnetically attracted to the material of the back flexible element 116 of the purse insert 16. Further, a magnetic force between the back magnet 98 and the back flexible element 116 may connect the purse insert 16 to the insert 14.

The purse insert 16 may be disengaged from the inner front portion 46 and/or the inner back portion 48 by opening the left fastener 82 and/or the right fastener 84 of the insert 14. Further, a force may be applied to separate the front rim 110 and/or the back rim 112 which may open the main opening 94 of the purse insert 16. The main opening 94 may be expanded to a size to release the front panel 86 and/or the back panel 88 from restraint by the front rim 110 and the back rim 112. The front panel 86 and the back panel 88 may then be removed from the purse inner volume 90 of the purse insert 16. The purse insert 16 may be transferred to an alternate insert (not shown in the figures), placed in the purse shell 122 or carried independently.

Further, the front panel 86 and/or the back panel 88 may be removed from the purse insert 16 by rotating the front panel 86 and the back panel 88 outwardly with respect to the purse insert 16. A user may apply a force to overcome the magnetic attraction between the front flexible element 114 and the front magnet 96 of the front panel 86, and the back flexible element 116 and the back magnet 98 of the back panel 88 before removing the front panel 86 and/or the back panel 88 from the purse inner volume 90 of the purse insert 16.

Figure 2B:
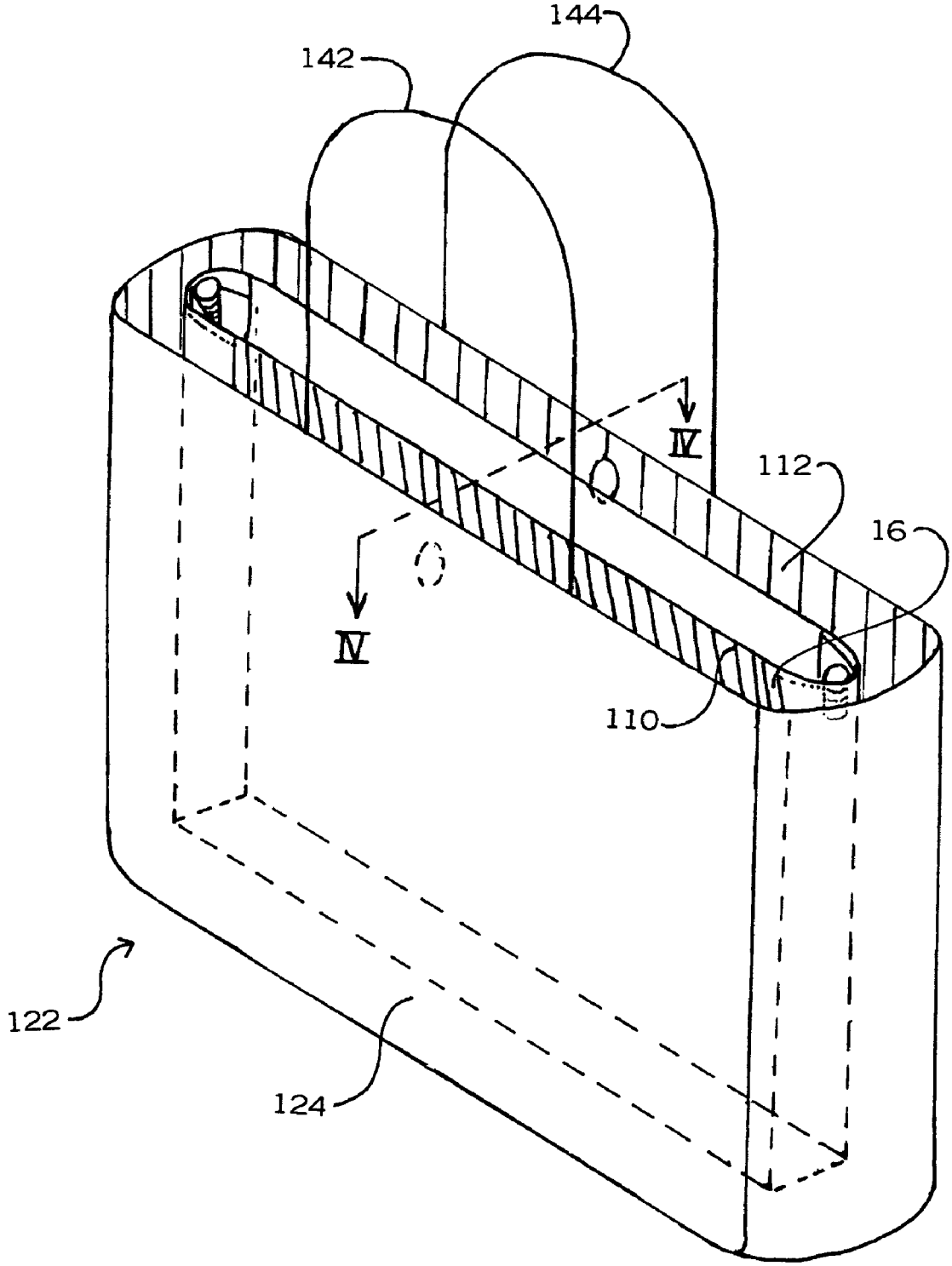
FIG. 2B illustrates a perspective view of a handbag with a purse outer shell and a purse insert in an embodiment of the present invention.

The purse insert 16 may be transported from and/or moved between the insert 14 and the purse shell 122. As shown in FIG. 2B and FIG. 4, the user may insert the purse insert 16 into the purse shell 122 by placing the purse insert 16 into the chamber 131 defined by the front section 124, the left section 126, the right section 128, the back section 130 and/or the bottom section 132 of the purse shell 122. In an embodiment, the front rim 110 of the purse insert 16 may rest below the front fastener 123 of the purse shell 122, and the back rim 112 of the purse insert 16 may rest below the back fastener 125 of the purse shell 122, as shown in FIG. 4. Further, the user may secure the purse insert 16 into the purse shell 122 by attaching the front fastener 123 of the purse shell 122 to the back fastener 125 of the purse shell 122.

The user may remove the purse insert 16 from the chamber 131 of the purse shell 122 by applying a force to overcome the attachment between the front fastener 123 of the purse shell 122 and the back fastener 125 of the purse shell 122. Further, the user may remove the purse insert 16 from the chamber 131 of the purse shell 122 by pushing down on the purse shell 122 with respect to the purse insert 16.

Figure 6A:
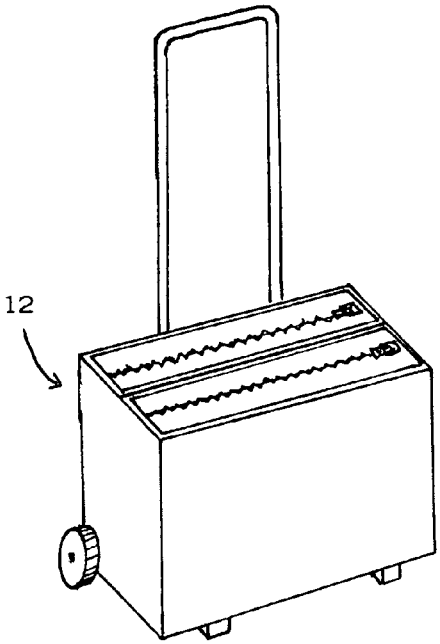
FIG. 6A illustrates a perspective view of an outer shell in an embodiment of the present invention.
Figure 6B:
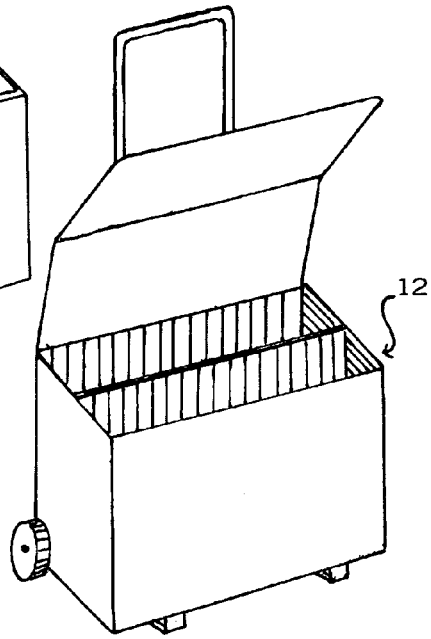
FIG. 6B illustrates a perspective view of an outer shell in an embodiment of the present invention.
Figure 6C:
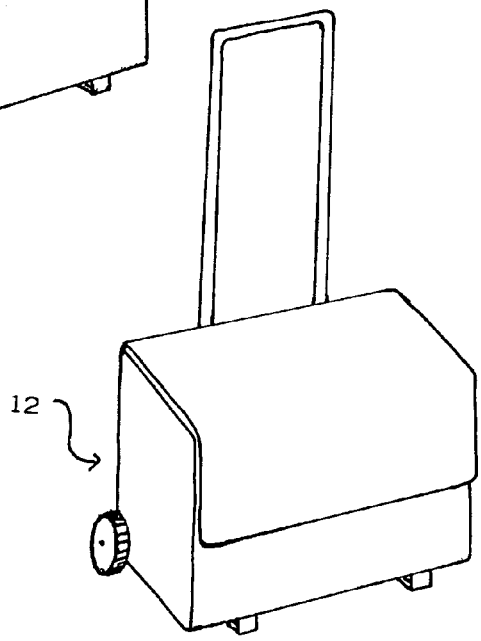
FIG. 6C illustrates a perspective view of an outer shell in an embodiment of the present invention.

The insert 14 and the purse insert 16 may be transported from the outer shell 12 to an alternate outer shell. As shown in FIGS. 6A, 6B and 6C, the alternate outer shell may be a suitcase, a roller bag, and/or the like. Further, the purse insert 16 may be transported from the insert 14 to an alternate insert (not shown in the figures) which may, in turn, be transported from the outer shell 12 to the alternate outer shell. The purse insert 16 may also be transported from the insert 14 to the purse shell 122. These possibilities may allow a user to configure the handbag 10 to his or her needs. Further, the purse insert 16 and the insert 14 may nest within the outer shell 12 to give the appearance of a single handbag.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by this specification.

I claim:

1. A handbag system for interchanging storage containers, the system comprising:

an outer shell having an open end wherein the outer shell has an exterior surface and an interior surface wherein the interior surface forms a first-cavity having a first volume within the outer shell and further wherein the outer shell has a height defined between a top edge and a bottom surface;

a first insert in the outer shell wherein the first insert has an open end wherein the first insert has an exterior surface and an interior surface wherein the interior surface forms a second cavity having a second volume within the first insert and further wherein the first insert is positioned within the first cavity of the outer shell wherein the first volume and the second volume are substantially equal in size;

an inner portion of the first insert wherein the inner-portion has walls wherein each wall has a height wherein the walls partition the second cavity of the first insert into a plurality of spaces;

a panel extending from each of the walls of the inner portion of the first insert wherein the panel extends beyond the height of each of the walls; and a second insert having an open end wherein the second insert has an exterior surface and an interior surface wherein the interior surface forms a third cavity having a third volume within the first insert and further wherein the second insert is removably placed in one of the plurality of spaces of the first insert wherein the panel of the first insert extends into the third cavity of the second insert to position the second insert within the one of the plurality of spaces of the first insert wherein the third volume is substantially smaller than the first volume and the second volume.

2. The handbag system of claim 1 further comprising:

a fastener at the top edge of the outer shell to close the first cavity of the outer shell.

3. The handbag system of claim 1 further comprising:

a fastener on the first insert to attach the first insert to the second insert.

4. The handbag system of claim 1 further comprising:

a flexible frame having a torsional spring wherein the flexible frame is positioned at the open end of the second insert wherein the flexible frame and the torsional spring maintain the open end of the second insert in an open position.

5. The handbag system of claim 1 further comprising:

a pocket on the interior surface of the second insert.

6. The handbag system of claim 1 further comprising:

a handle extending from the outer shell wherein the handle forms a loop to hold the outer shell.

7. The handbag system of claim 1 wherein the second insert has a height and further wherein the height of the walls of the inner portion of the first insert are greater than the height of the second insert.

8. The handbag system of claim 1 wherein the first insert has a length and further wherein the second insert has a length wherein the length of the first insert is greater than the length of the second insert.

9. The handbag system of claim 1 further comprising:

an internal flex frame at a top end of the first insert wherein the internal flex frame is flexible.

10. A handbag for interchanging storage containers, the handbag comprising:

an outer shell having a bottom end and an open end wherein the outer shell has walls defining an inner volume of the outer shell wherein the walls have a height defined between the bottom end and the open end;

an insert positioned within the inner volume of the outer shell wherein the insert has an open end wherein the insert has walls defining an inner volume of the insert;

a flexible frame forming a rim of the insert at the open end wherein the flexible frame moves between an open position and a closed position; and a panel extending beyond the height of each of inner walls of the outer shell wherein the panels pivot with respect to the walls of the outer shell wherein the panels extend around the flexible frame into the inner volume of the insert wherein the inner volume of the outer shell is substantially greater than the inner volume of the insert.

11. The handbag of claim 10 further comprising:

a magnet associated with the panel wherein the magnet is attracted to the flexible frame to attach the panel to the flexible frame.

12. The handbag of claim 10 further comprising:

a hinged member of the flexible frame at the open end of the insert wherein the hinged member is not elastically deformed when the open end of the insert is in a closed position and further wherein the hinged member is elastically deformed when the open end of the insert is in an open position.

13. The handbag of claim 10 further comprising:

a torsional spring associated with the flexible frame that resists a separation of the flexible frame.

14. A method for using a handbag system wherein the handbag system is used to carry articles, the method comprising the steps of:

providing a handbag system having an outer shell, a first insert and a second insert wherein the outer shell has a first height and the first insert has a second height wherein the first height and the second height are substantially equal wherein the first insert has two compartments defined by walls with a flap extending beyond the height of at least one of the walls of the first insert wherein the flap pivots with respect to the wall wherein the second insert fits within one of the two compartments of the first insert and further wherein the first insert fits within the outer shell wherein each of the outer shell, the first insert and the second insert has an inner volume forming a space for holding the articles wherein each of the outer shell, the first insert and the second insert has an open end to access the inner volume and further wherein the inner volume of the outer shell and the second insert are substantially equal and substantially greater than the inner volume of the second insert;

placing the first insert into the outer shell;

placing the second insert in the first insert; and moving the flap of the first insert into the inner volume of the second insert.

15. The method of claim 14 further comprising the step of:

attaching the outer shell to the first insert with a fastener.

16. The method of claim 14 further comprising the step of:

attaching the flap of the first insert to the second insert with a fastener.

17. The method of claim 14 further comprising the step of:

closing the open end of the outer shell with a fastener to enclose the first insert and the second insert within the inner volume of the outer shell.

18. The method of claim 14 further comprising the step of:

closing the open end of the first insert with a fastener to enclose the second insert within the inner volume of the first insert.

19. The method of claim 14 further comprising the step of:

providing pockets within the inner volume of the second insert to hold the articles.

20. The method of claim 14 further comprising the step of:

providing a strap attached to the outer shell.

21. A handbag system for interchanging storage containers, the system comprising:

an outer shell having an open end wherein the outer shell has an exterior surface and an interior surface wherein the interior surface forms a first cavity within the outer shell and further wherein the outer shell has a height defined between a top edge and a bottom surface;

a first insert in the outer shell wherein the first insert has an open end wherein the first insert has an exterior surface and an interior surface wherein the interior surface forms a second cavity within the first insert and further wherein the first insert is positioned within the first cavity of the outer shell;

an inner portion of the first insert wherein the inner portion has walls wherein each wall has a height wherein the walls partition the second cavity of the first insert into a plurality of spaces;

a panel extending from each of the walls of the inner portion of the first insert wherein the panel extends beyond the height of each of the walls;

a second insert having an open end wherein the second insert has an exterior surface and an interior surface wherein the interior surface forms a third cavity within the first insert and further wherein the second insert is removably placed in one of the plurality of spaces of the first insert wherein the panel of the first insert extends into the third cavity of the second insert to position the second insert within the one of the plurality of spaces of the first insert; and a flexible frame having a torsional spring wherein the flexible frame is positioned at the open end of the second insert wherein the flexible frame and the torsional spring maintain the open end of the second insert in an open position.

* * * * *